US005592703A

United States Patent [19]

Jones et al.

[11] Patent Number: 5,592,703

[45] Date of Patent: Jan. 14, 1997

[54] POWERED TOILET SEAT LIFT

[75] Inventors: David L. Jones, Houston; George L. Drenner, Jr., Sugar Land, both of Tex.

[73] Assignee: Mobility Plus, Inc., Houston, Tex.

[21] Appl. No.: 613,467

[22] Filed: Mar. 11, 1996

[51] Int. Cl.[6] ..... A47K 13/10

[52] U.S. Cl. ..... 4/667; 297/DIG. 10

[58] Field of Search ..... 4/667, 254, 246.2, 4/246.1, 248; 297/DIG. 10

[56] References Cited

U.S. PATENT DOCUMENTS

| | | | |
|---|---|---|---|
| 3,060,458 | 10/1962 | Burke | 4/237 |
| 3,473,174 | 10/1969 | Cool | 4/667 |
| 3,925,833 | 12/1975 | Hunter | 4/251 |
| 4,031,576 | 6/1977 | Epstein | 4/251 |
| 4,091,473 | 5/1978 | Matthews et al. | 4/420 |
| 4,168,552 | 9/1979 | Austin | 4/237 |
| 4,185,335 | 1/1980 | Alvis | 4/667 |
| 4,399,572 | 8/1983 | Johansson | 5/81 R |
| 4,581,778 | 4/1986 | Pontoppidan | 4/251 |
| 4,587,678 | 5/1986 | Love et al. | 4/251 |
| 4,884,841 | 12/1989 | Holley | 4/254 |
| 4,993,085 | 2/1991 | Gibbons | 4/667 |
| 5,063,617 | 11/1991 | Ward et al. | 4/667 |
| 5,142,709 | 9/1992 | McGuire | 4/667 |

FOREIGN PATENT DOCUMENTS

| | | | |
|---|---|---|---|
| 4215448 | 11/1992 | Germany | 4/667 |

*Primary Examiner*—Henry J. Recla
*Assistant Examiner*—Charles R. Eloshway
*Attorney, Agent, or Firm*—Vaden, Eickenroht, & Thompson, L.L.P.

[57] ABSTRACT

An apparatus is provided for moving a toilet seat between a lowered position immediately above a toilet bowl and a raised position above the toilet bowl to assist a physically disabled person to use a toilet. The apparatus includes a toilet seat having a passageway therethrough, a baseplate positioned about the base of a toilet bowl, and a pair of fluid power cylinders supporting the toilet seat for vertical movement between a lowered position immediately above the toilet bowl and an raised position from which the person can easily move between a standing position and a position at least partially supported on the toilet seat. Each of the cylinders has a piston rod extending downwardly therefrom and connected to the baseplate. Fluid lines provide pressurized fluid to the cylinders through the passageway in the toilet seat. Control means deliver the pressurized fluid to the cylinders to raise the toilet seat from the lowered position to the raised position, and exhaust pressurized fluid from the cylinders to lower the toilet seat from the raised position to the lowered position whereby a physically disabled person is assisted down to and up from a seated position immediately above the toilet bowl.

3 Claims, 2 Drawing Sheets

FIG. 1
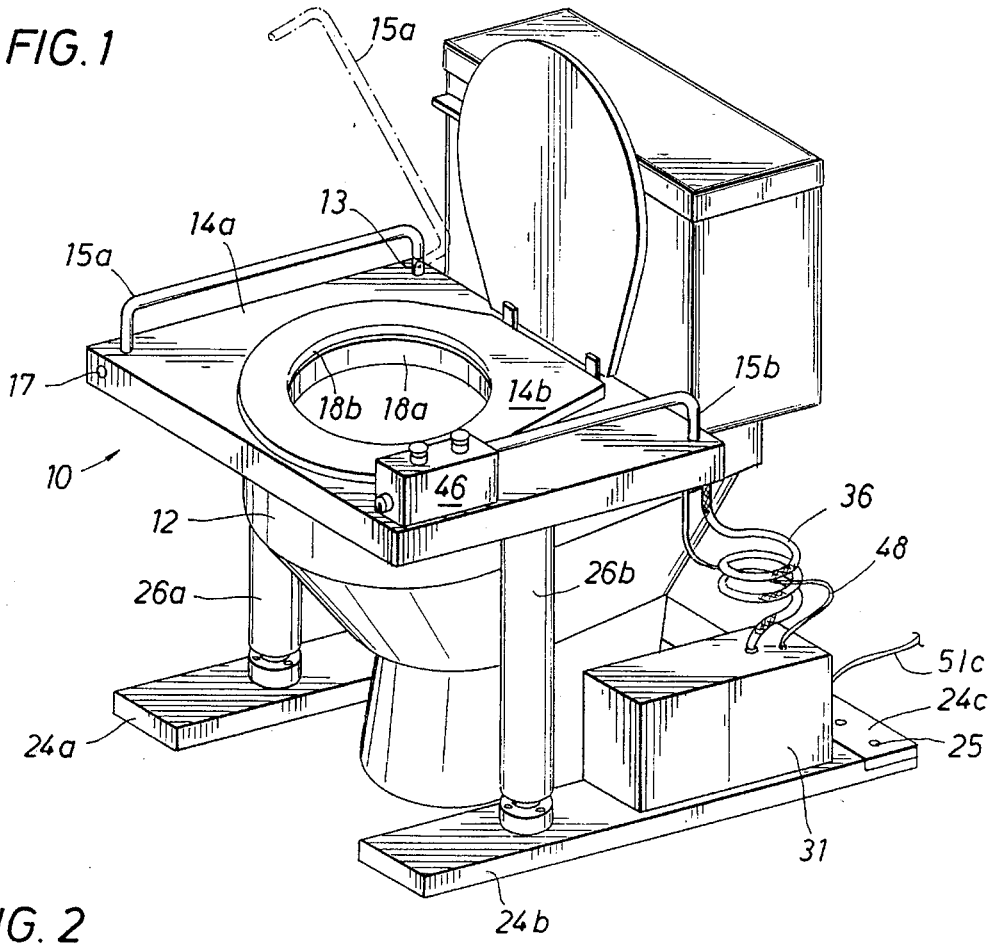
FIG. 2
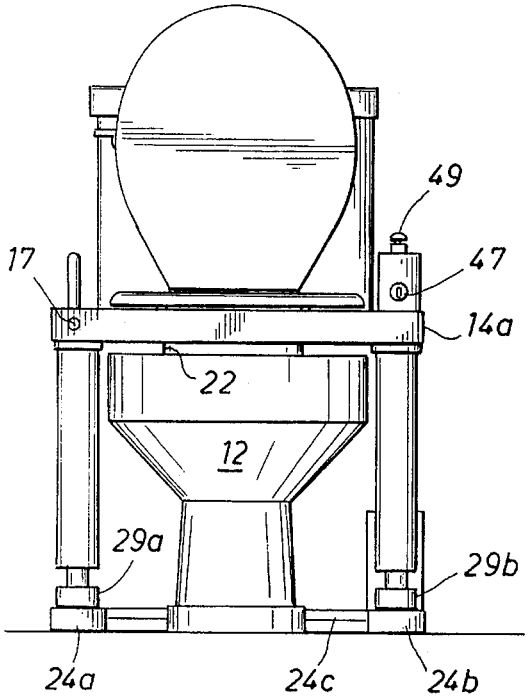
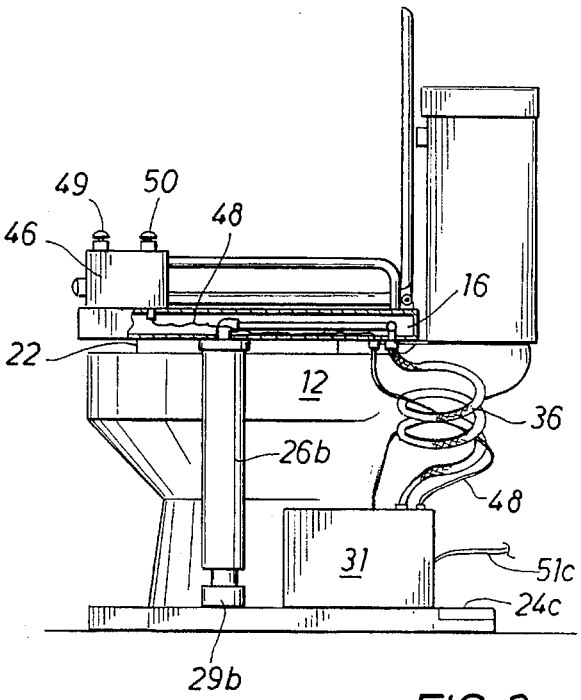
FIG. 3

POWERED TOILET SEAT LIFT

BACKGROUND OF THE INVENTION

1. Field of the Invention

The present invention relates to devices for assisting physically disabled persons to and from a position for using a toilet.

2. The Related Art

Conventional toilet seats are characteristically low to the ground, making it very difficult for physically disabled or illness-weakened persons to use the toilet without the assistance of a nurse or other individual. Elevated toilet seats partially solve the problem by reducing the period of time that a person's arm and leg muscles are stressed when moving between a standing position and a sitting position above a toilet bowl. Thus, the person's center of gravity is shifted very little under his or her own strength and the likelihood of becoming unbalanced or requiring assistance is greatly diminished.

Two examples of such elevated toilet seats are described in U.S. Pat. Nos. 3,060,458 and 4,168,552. The '458 patent discloses a toilet seat whose elevation is adjusted by a pair of hydraulic cylinders for use by small children as well as adults. A pair of switches are mounted to a baseplate about the base of a toilet for lifting and lowering the toilet seat. The floor location of these switches makes the apparatus of the '458 patent unsuitable for physically disabled or weakened persons because they would have to bend down to the floor to operate the apparatus. In other words, users capable of reaching the switches of this device will probably not need assistance in moving between a standing position and a seated position on a toilet seat over a toilet bowl. Furthermore, this device requires a sump for the storage of hydraulic fluid when the seat is moved to a lowered position. Still further, the limited baseplate design of this apparatus requires that the baseplate be permanently bolted to the floor to ensure that the device doesn't topple over when used. Thus, the apparatus of the '458 patent is not very portable, and cannot easily be moved between different toilets in a house or a care facility.

The '552 patent describes an adjustable toilet seat that is elevated by screw jacks driven by an electric motor through a drive belt and pulley system. The drive system takes up considerable floor space about the base of the toilet, and is not easily assembled or transported to another toilet. The screws of the jacks extend upwardly through a jack housing and create a crush and/or pinch zone between the jack housing and the toilet seat. Thus, the user's hands and fingers are exposed to injury by the operation of this device. Furthermore, electrical wiring is run to a switch assembly on the '552 device adjacent this crush zone, and is also exposed to entanglement or crimping during operation.

In response to the above-described problems in the art, it is an object of the present invention to provide an apparatus for assisting a physically disabled person to and from a seated position immediately above a toilet bowl that requires a minimum of floor space, and can be easily moved from one toilet to another.

It is a further object to provide an apparatus that need not be permanently mounted to the floor for safe operation.

It is a further object to provide such an apparatus that provides an easily accessible control panel having control wiring routed through a passageway in the toilet seat to avoid entanglement with the moving component of the apparatus.

It is a still further object to provide such an apparatus that does not expose the user's hands to injury during operation.

It is a further object to provide an apparatus that is easy to operate and that accommodates individuals of virtually any size.

It is a further object to provide a fail safe apparatus that will lower the person seated on the toilet seat at a controlled rate, even if a system failure occurs.

SUMMARY

The objects described above, as well as other objects and advantages are achieved by an apparatus that includes a toilet seat having a passageway therethrough, a baseplate positioned about the base of a toilet bowl, and a pair of fluid power cylinders supporting the toilet seat for vertical movement between a lowered position above the toilet bowl and an raised position from which the person can easily move between a standing position and a position at least partially supported on the toilet seat. Each of the cylinders has a piston rod extending downwardly therefrom and connected to the baseplate. Means provide pressurized fluid to the cylinders through the passageway in the toilet seat. Control means deliver the pressurized fluid to the cylinders to raise the toilet seat from the lowered position to the raised position, and exhaust pressurized fluid from the cylinders to lower the toilet seat from the raised position to the lowered position whereby a physically disabled person is assisted down to and up from a seated position immediately above the toilet bowl.

In the preferred embodiment, the power cylinders are pressurized by an air compressor and support the toilet seat on opposite sides of the toilet bowl. The control means is carried by the toilet seat, which includes a rectangular housing having a passageway for passage of control wiring between the control means and the air compressor and for passage of an air line between the air compressor and the power cylinders.

BRIEF DESCRIPTION OF THE DRAWINGS

In the drawings, wherein like reference characters are used throughout to describe like parts:

FIG. 1 is a perspective view of the powered toilet seat lift of the present invention installed about a typical toilet bowl and tank;

FIG. 2 is a front elevational view of the powered toilet seat lift in a lowered position;

FIG. 3 is a side elevational view, partially in section, of the powered toilet seat lift in a lowered position;

DETAILED DESCRIPTION OF THE PREFERRED EMBODIMENT

Figure 4:
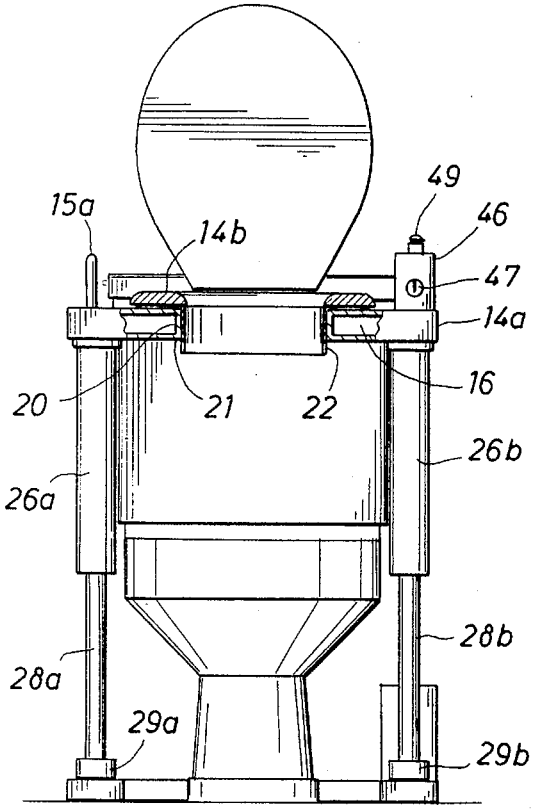
FIG. 4 is a front elevational view, partially in section, of the powered toilet seat lift in a raised position.

FIG. 1 illustrates apparatus 10 of the present invention for assisting physically disabled or illness-weakened persons down to and up from a seated position immediately above toilet bowl 12. The person is supported for such movement atop a "toilet seat" that includes both lift platform **14*a* and standard oval-shaped toilet seat 14*b*. Lift platform 14*a* is equipped with handles 15***a* and 15*b* for gripping by the user of apparatus 10 during ascent and descent.

One of the handles 15*a* is connected through hinge 13 at one end thereof to plate 14*a* and releasably attached to the plate at the other end thereof with a locking mechanism (not shown) that is released by pressing button 17. This feature enables handle 15*a* to swing upwardly about hinge 13, as shown in imaginary lines in FIG. 1, providing access to seat 14 from either the front or side of the seat to accommodate users needing additional room to maneuver onto seat 14, such as from a wheelchair.

Figure 6:
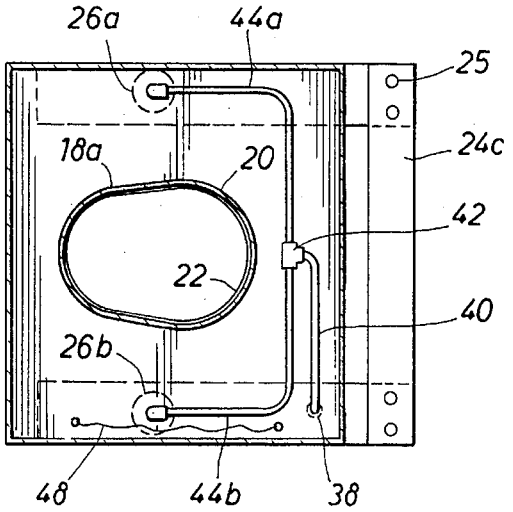
FIG. 6 is a plan view, partially in section, of the powered toilet seat lift taken along section 6—6 in FIG. 5.

Plate 14*a* and seat 14*b* are further equipped with openings 18*a* and 18*b*, respectively, providing access to toilet bowl 12. Plate 14*a* is hollow and has a passageway 16 therethrough, as shown in FIGS. 3 and 4, for purposes that will be explained below. Insert 20 is permanently sealed with O-ring 21 about opening 18*a* to close off passageway 16, as illustrated in FIGS. 4 and 6. Removable liner 22 is hung within insert 20 by a lip about the top of the liner and extends beneath lift platform 14*a* to provide a flowway into toilet bowl 12 when the platform is in the lowered position, and provide a flowway in the direction of toilet bowl 12 when lift platform 14*a* is in the raised position.

A baseplate is positioned about the base of toilet bowl 12, and includes main plates 24*a* and 24*b* and cross plate 24*c* connecting the main plates behind the toilet bowl with bolts 25. Cross plate 24*c* is mounted across reduced thickness sections at the rear edges of main plates 24*a*, 24*b* to ensure that the main plates are parallel and square relative to one another. The baseplate may be permanently attached to the floor of a restroom, but will provide adequate support for apparatus 10 if merely laid upon the floor as well. Non-skid rubber pads are attached to the bottoms of main plates 24*a*, 24*b* to make them stationary.

Figure 5:
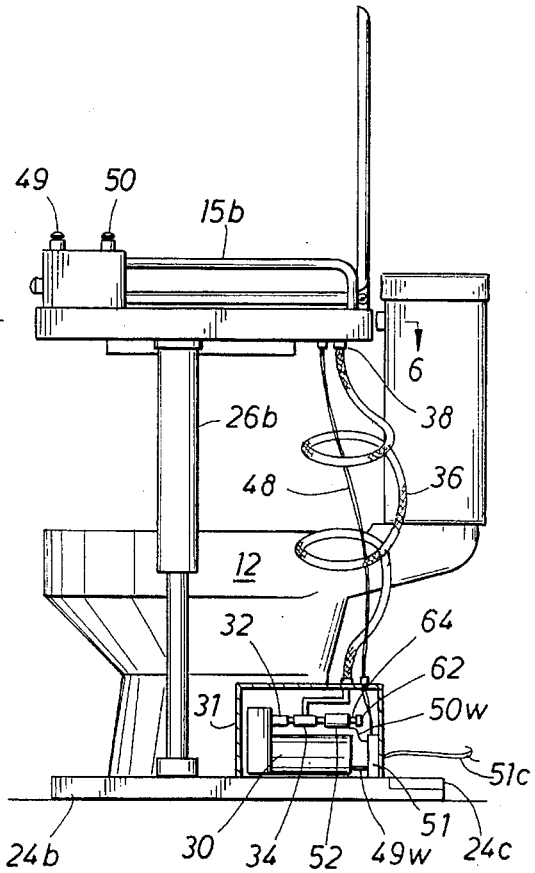
FIG. 5 is a side elevational view, partially in section, of the powered toilet seat lift in a raised position.

Pneumatic cylinders 26*a* and 26*b* support lift platform 14*a* and toilet seat 14*b* for vertical movement between a lowered position approximately one inch above toilet bowl 12 as shown in FIGS. 1, 2, and 3, and a raised position from which the user can easily move between a standing position and a position at least partially supported by the toilet seat as seen in FIGS. 4 and 5. The lowered position is set slightly above the toilet bowl to eliminate a pinch zone between lift platform 14*a* and the bowl. In operation, the standing user will transfer a portion of his or her weight to the seat in the raised position. As the seat is lowered by cylinders 26*a*, 26*b*, the user gradually transfers the remainder of his or her weight to the seat and slides into a fully supported seated position atop lift platform 14*a* and toilet seat 14*b*. After using the toilet, cylinders 26*a*, 26*b* raise the seat and the user upwardly, and the user's weight is gradually transferred back to his or her feet until the user is only partially supported by lift platform 14*a* and little effort is required to assume a standing position.

Each of the cylinders has a piston rod 28*a*, 28*b* extending downwardly therefrom and respectively connected to main plates 24*a* and 24*b* of the baseplate through cylinder mounts 29*a*, 29*b*. The leading edges of plates 24*a*, 24*b* extend several inches forward of cylinder mounts 29*a*, 29*b* to ensure that apparatus 10 will not tip forward when loaded with the weight of a user.

FIG. 5 illustrates ⅙ hp air compressor/electric motor unit 30, such as Gast Manufacturing Model SOA-18282-A01-NQ, that provides compressed air to the cylinders through passageway 16 in lift platform 14*a*. The compressed air is delivered through check valve 32 and T-connector 34 and passes out of compressor housing 31 into ⅜ inch diameter coiled air hose 36. The air is forced through the top of T-connector 34 and into coiled air hose 36 because electric valve 52 is closed when the compressor is activated. From hose 36, the compressed air flows through connector 38 into ¼ inch diameter hose 40 within passageway 16 of platform 14*a* as shown in FIG. 6. Hose 40 is split at T-connector 42 into hoses 44*a* and 44*b* of identical length, which respectively deliver the compressed air to cylinders 26*a* and 26*b*. Thus, cylinders 26*a*, 26*b* raise lift platform 14*a* at the same rate because the pressure in hose 44*a* is equal to the pressure in hose 44*b*.

Control panel 46 is carried by plate 14*a*, and communicates with air compressor 30 and electric valve 52 through control cable 48 which passes through passageway 16 and which carries compressor wiring 49*w* and electric valve wiring 50*w* as displayed in FIG. 5. Switches 49 and 50, such as Normally/Open Mushroom Lighted Switches by Telemecanique, are mounted atop control panel 46 for operation of apparatus 10. The switches are of the "momentary" type in that they will produce the desired result only as long as the user holds the switch down. The switches are energized and de-energized by keyed controller 47 as a child-proofing measure. Ground fault interrupter 51 is connected between control panel 46 and air compressor 30 and electric valve 52 with compressor wiring 49*w* and electric valve wiring 50*w*, respectively. Electrical power is delivered through the ground fault interrupter to compressor 30 and electric valve 52 via electrical cord 51*c*.

Switch 49 is color-coded green, and by pressing it the user activates compressor 30 to provide compressed air to cylinders 26*a* and 26*b* whereby lift platform 14*a* will be lifted upwardly from the lower position immediately above the toilet bowl. The upper position of platform 14*a* is adjustable according to the height of the user to an ultimate upper position defined by the stroke of the pistons within cylinders 26*a* and 26*b*. Air hose 36 and control cable 48 are of sufficient length to accommodate a wide range of user heights. The user simply releases switch 49 once the desired upper position is reached. The compressor is then deactivated and cylinders 26*a*, 26*b* and lift platform 14*a* will be locked in place by the pressure of the air in the hoses, which is contained by check valve 32 and the closed position of electric valve 34. From the locked upper position, the user can move between a position partially supported on lift platform 14*a* and toilet seat 14*b* and a standing position with a minimum of effort and movement.

Switch 50 is color-coded red and it activates electric valve 52 such that the pressurized air in cylinders 26*a*, 26*b* and hoses 36, 40, 44*a* and 44*b* is vented to the atmosphere through orifice 64 and air filter 62. Orifice 64 is sized at 1/16 inch diameter opening for limiting the rate at which air is vented, and thus controls the rate of descent for seat 14*b*. Pneumatic cylinders 26*a* and 26*b* are also equipped with 1/16 inch diameter orifices at the respective connections thereof with hoses 44*a* and 44*b* for redundant controls on the rate at which air is expressed from the cylinders. In this manner, users of apparatus 10 will be ensured of a safe controlled rate of descent from the upper position to the lower position immediately above toilet bowl 12.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. An apparatus for moving a toilet seat between a lowered position above a toilet bowl and a raised position above the toilet bowl to assist a physically disabled person in using a toilet, comprising:

a toilet seat comprising a hollow platform defining a central opening therethrough for communication with said toilet bowl and having an enclosed interior passageway;

a baseplate adapted to be positioned about a base portion of the toilet bowl;

a pair of fluid power cylinders for supporting the toilet seat for vertical movement between the lowered position and the raised position from which the person can easily move between a standing position and a position at least partially supported by said toilet seat, each of said cylinders having a piston rod extending downwardly therefrom and connected to said baseplate;

means for providing pressurized fluid to said cylinders through the enclosed interior passageway in said toilet seat;

means for exhausting pressurized fluid from said cylinders; and control means carried by said toilet seat and communicating through the enclosed interior passageway with said pressurized fluid providing means and said pressurized fluid exhausting means for delivering pressurized fluid to said cylinders to raise said toilet seat from the lowered position to the raised position and exhausting pressurized fluid from said cylinders to lower said toilet seat from the raised position to the lowered position whereby the person is assisted up from and down to a seated position immediately above the toilet bowl.

2. The apparatus of claim 1 wherein said power cylinders support said toilet seat on opposite sides of the toilet bowl.

3. The apparatus of claim 1 wherein said pressurized fluid providing means includes an air compressor and an air line passing through the enclosed interior passageway and connecting said air compressor with said power cylinders for providing compressed air to said power cylinders.

* * * * *